US011597108B2

(12) United States Patent
Godlieb

(10) Patent No.: US 11,597,108 B2
(45) Date of Patent: Mar. 7, 2023

(54) CUTTING UNIT AND SHAVING HEAD OF A SHAVING DEVICE

(71) Applicant: KONINKLIJKE PHILIPS N.V., Eindhoven (NL)

(72) Inventor: Robert Godlieb, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/069,914

(22) Filed: Oct. 14, 2020

(65) Prior Publication Data

US 2021/0023728 A1 Jan. 28, 2021

Related U.S. Application Data

(62) Division of application No. 15/572,183, filed as application No. PCT/EP2016/060116 on May 5, 2016, now Pat. No. 10,836,057.

(30) Foreign Application Priority Data

May 21, 2015 (EP) ..... 15168613

(51) Int. Cl.
*B26B 19/14* (2006.01)

(52) U.S. Cl.
CPC ..... *B26B 19/141* (2013.01); *B26B 19/14* (2013.01)

(58) Field of Classification Search
CPC ..... B26B 19/14; B26B 19/141; B26B 19/143; B26B 19/145; B26B 19/146; B26B 19/148; B26B 19/16; B26B 19/384; B26B 19/3846; B26B 19/3893
USPC ..... 30/43.4–43.6, 346.51, 347, 350
See application file for complete search history.

(56) References Cited

U.S. PATENT DOCUMENTS

| | | | | |
|---|---|---|---|---|
| 3,116,551 | A | 1/1964 | Anton | |
| 3,261,091 | A | 7/1966 | Van Den Driest | |
| 4,038,748 | A | 8/1977 | Tyler | |
| 4,077,120 | A | 3/1978 | Herrick | |
| 4,089,110 | A * | 5/1978 | Rasco | B26B 19/44 30/41.5 |

(Continued)

FOREIGN PATENT DOCUMENTS

| | | | |
|---|---|---|---|
| CN | 101474797 | A | 7/2009 |
| CN | 102284963 | A | 12/2011 |

(Continued)

OTHER PUBLICATIONS

Kurtus, Ron; Basics of Magnetism; Jan. 2013; obtained from https://school-for-champions.com/science/magnetism.htm on Sep. 21, 2021 (Year: 2013).*

(Continued)

*Primary Examiner* — Evan H MacFarlane

(57) ABSTRACT

A cutting unit of a shaving head of a shaving device, which cutting unit includes an external cutting member and an internal cutting member. In an interconnected condition, a holding force prevents the external and internal cutting members from moving apart. The holding force is at least exerted by a first central portion of the external cutting member upon a second central portion of the internal cutting member, and/or vice versa. The holding force may for example be provided by a snap connection or magnetic attraction between the first and second central portions.

18 Claims, 5 Drawing Sheets

(56) References Cited

U.S. PATENT DOCUMENTS

| | | | | |
|---|---|---|---|---|
| 6,032,365 | A * | 3/2000 | Hodges | B26B 19/14 30/346.51 |
| 6,145,200 | A | 11/2000 | Jorna | |
| 6,199,282 | B1 | 3/2001 | Uchiyama | |
| 6,460,252 | B1 * | 10/2002 | Nakano | B26B 19/141 30/346.51 |
| 7,530,171 | B2 | 5/2009 | Baron | |
| 8,132,332 | B2 * | 3/2012 | Tautscher | B26B 19/06 30/208 |
| 8,191,264 | B2 | 6/2012 | Veenstra | |
| 2003/0019107 | A1 | 1/2003 | Visman | |
| 2005/0241153 | A1 | 11/2005 | Koike | |
| 2006/0059690 | A1 | 3/2006 | Koike | |
| 2006/0260130 | A1 | 11/2006 | Shimizu | |
| 2009/0320294 | A1 | 12/2009 | Shimizu | |
| 2009/0320295 | A1 * | 12/2009 | Shimizu | B26B 19/145 30/43.6 |
| 2010/0011589 | A1 | 1/2010 | Van Der Borst | |
| 2010/0275446 | A1 | 11/2010 | Schmitt | |
| 2014/0165407 | A1 | 6/2014 | Ohara | |

FOREIGN PATENT DOCUMENTS

| | | | |
|---|---|---|---|
| CN | 203495989 | U | 3/2014 |
| EP | 1170098 | A2 | 1/2002 |
| JP | 6379689 | A | 4/1988 |
| WO | 9950033 | A1 | 10/1999 |
| WO | 2011055323 | A1 | 5/2011 |

OTHER PUBLICATIONS

Engineering Exchange, 11 Principles and Guidelines in Design for Manufacturing and Assembly, Jul. 12, 2014, retrieved from https://www.engineeringexchange.com/profiles/blogs/11-principles-and-guidelines-in-design-for-manufacturing-and on Feb. 7, 2019 (Year: 2014).*

Ruan, Tieming: "Selection and Optimization of Snap-Fit Features Via Web-Based Software", The Ohio State University, pp. ii and 6 (Year: 2005).

* cited by examiner

CUTTING UNIT AND SHAVING HEAD OF A SHAVING DEVICE

CROSS-REFERENCE TO RELATED APPLICATION

This application is a Divisional of U.S. patent application Ser. No. 15/572,183, filed on Nov. 7, 2017, which is the U.S. National Phase application under 35 U.S.C. § 371 of International Application No. PCT/EP2016/060116, filed on May 5, 2016, which claims the benefit of European Patent Application No. 15168613.6 filed on May 21, 2015. These applications are hereby incorporated by reference herein.

FIELD OF THE INVENTION

The invention relates to a shaving device for shaving hairs. More specifically, the invention relates to a cutting unit for use in a shaving device for shaving hairs, said cutting unit comprising:

an external cutting member comprising a shaving surface, which is interrupted by an apertured structure for allowing hairs to pass; and an internal cutting member, which is drivable for rotative movement relative to the external cutting member about a rotation axis and along said apertured structure in the shaving surface of the external cutting member for cutting through hairs passing said apertured structure;

and wherein:

the external cutting member and the internal cutting member have:

an interconnected condition, in which the external cutting member and the internal cutting member are mutually interconnected for operation of the cutting unit, and a disconnected condition, in which the external cutting member and the internal cutting member are mutually disconnected for taking at least the internal cutting member out of the external cutting member for cleaning the cutting unit.

The invention also relates to a shaving head for use in a shaving device for shaving hairs, wherein said shaving head comprises at least one cutting unit of the type described here before.

BACKGROUND OF THE INVENTION

For cutting units and shaving heads of the above-identified types, there are a number of desirable design requirements.

A first desirable design requirement is that changing the condition of the external and internal cutting members from the abovementioned interconnected condition into the abovementioned disconnected condition, and vice versa, should be possible through manual operations by a user.

A second desirable design requirement is that said manual operations should neither require nor allow the user to directly touch the internal cutting member at a moment when the internal cutting member is drivably connected to its rotative drive structure. Thus, it is prevented that the user might get hurt in case of inadvertent activation of the rotative drive structure.

A third desirable design requirement is that, after the external and internal cutting members have been correctly brought into the abovementioned interconnected condition, the internal cutting member will be kept correctly positioned against the external cutting member during the subsequent connecting of the internal cutting member to its rotative drive structure. Thus, it is prevented that the cutting members, due to incorrect relative positioning thereof, might get damaged upon activation of the rotative drive structure.

In view of these desirable design requirements, a cutting unit of a shaving head of the initially identified type often is designed with a separate support device, also referred to as "retainer". This separate retainer is manually moveable between a retaining position, in which the internal cutting member is retained by the retainer in a correct operating position relative to the external cutting member, and a release position in which a user can remove the internal cutting member from the external cutting member.

An example of a known shaving head having such a retainer is disclosed in WO 2011/055323 A1. This shaving head 3 and details thereof are shown in FIGS. 1-8 of WO 2011/055323 A1. It is shown that each cutting unit 6 of the shaving head 3 has an external cutting member 7, an internal cutting member 10, and a retainer 21. The retainer 21 is connected to the external cutting member 7 in a pivotable manner so as to enable said manual moveability between said retaining position and said release position. In its retaining position, the retainer 21 can be locked relative to the external cutting member 7, while the internal cutting member 10 is retained in-between the retainer 21 and the external cutting member 7. FIGS. 2-7 clearly illustrate various conditions of one of the cutting units 6. For example, it is clearly seen how the retainer 21, in its locked condition, is able to keep the internal cutting member 10 correctly positioned against the external cutting member 7 for subsequent connection of the internal cutting member 10 to its rotative drive shaft 30.

It is also clearly seen that the internal cutting member 10 can be manually moved out of the cutting unit when the internal cutting member 10 is not drivably connected to the drive shaft 30, see FIG. 7 of WO 2011/055323 A1. Furthermore, it is clear that the cutting unit 6 does not allow the user to directly touch the internal cutting member at a moment when the internal cutting member is drivably connected to its rotative drive structure.

It is noted that in practice various other types of separate retainers are known, which can be locked relative to an external cutting member, while retaining an internal cutting member in-between the retainer and the external cutting member. Most of these other separate retainers are not pivotably connected to the external cutting member. Instead, after a user has manually unlocked such other retainer relative to its corresponding cutting unit, such other retainer is fully detachable from the external cutting member in a translation direction parallel to the rotation axis of the cutting unit. Most of these other retainers are small, more or less ring-like parts, while there exist many different locking mechanisms for the existing many different retainer types.

A general drawback of most of these known retainers is that the manual operations required for removing and inserting the internal cutting members relative to their cutting units are not easy for users to understand and/or perform and/or remember. For example, the locking and unlocking of the retainers relative to their corresponding cutting units often is cumbersome, especially because most of these retainers are small parts which are difficult to operate accurately with the fingers, and which have very tiny locking parts which are difficult to discern with the naked eye.

Another general drawback of most of these known retainers is that these known retainers are in fact additional parts of the cutting unit or shaving head, and that they require additional space within the cutting unit or shaving head.

SUMMARY OF THE INVENTION

It is an object of the invention to meet the above-described three desirable design requirements, while at the same time the internal cutting members can be manually removed and inserted relative to their cutting units in a very easy, comfortable and intuitive manner, and while at the same time the structure to achieve all this is non-complex and compact.

For that purpose, the invention provides a cutting unit and a shaving head. Consequently, the invention provides a cutting unit for use in a shaving device for shaving hairs, said cutting unit comprising:

- an external cutting member comprising a shaving surface, which is interrupted by an apertured structure for allowing hairs to pass; and
- an internal cutting member, which is drivable for rotative movement relative to the external cutting member about a rotation axis and along said apertured structure in the shaving surface of the external cutting member for cutting through hairs passing said apertured structure;

and wherein:

- the external cutting member and the internal cutting member have:
- an interconnected condition, in which the external cutting member and the internal cutting member are mutually interconnected for operation of the cutting unit, and
- a disconnected condition, in which the external cutting member and the internal cutting member are mutually disconnected for taking at least the internal cutting member out of the external cutting member for cleaning the cutting unit;
- the external cutting member has a first central portion and the internal cutting member has a second central portion, wherein in said interconnected condition said rotation axis is a centre line of the first central portion as well as of the second central portion;
- in said interconnected condition a holding force prevents the external cutting member and the internal cutting member from moving apart into the disconnected condition;
- said holding force is at least exerted by the first central portion upon the second central portion, and/or vice versa; and
- said disconnected condition is obtainable from said interconnected condition by manually moving the external cutting member and the internal cutting member away from one another in a direction parallel to said rotation axis by means of a manual force action overcoming said holding force.

Consequently, according to the invention, said holding force is provided directly between the external cutting member and the internal cutting member, which obviates the need for an additional separate retainer to retain the internal cutting member in-between the retainer and the external cutting member. The fact that said holding force is provided, more specifically, via said two central portions of the internal and external cutting members, respectively, still allows for rotative movement of the internal and external cutting members relative to one another about the rotation axis, which is aligned with the centre line of the two central portions. Furthermore, in order to disconnect the internal cutting member from the external cutting member, a user only needs to exert a simple and intuitive one-directional pulling force to overcome said holding force.

A preferable embodiment of the invention is defined in that, in said interconnected condition, the first central portion and the second central portion are mutually co-operating portions providing radial bearing support for said rotative movement. In this way, the two central portions of the internal and external cutting members have a multifunctional character, which further improves the compactness of the cutting unit.

A further preferable embodiment of the invention is defined in that the first central portion of the external cutting member comprises a first snap connection structure and the second central portion of the internal cutting member comprises a second snap connection structure, and wherein the first snap connection structure and the second snap connection structure mutually co-operate for providing at least part of said holding force by means of a snap connection. For users, such a snap connection is an easy and intuitive manner of realizing said holding forces.

Preferably, in said interconnected condition, the first snap connection structure and the second snap connection structure provide radial bearing support for said rotative movement. In this way, the snap connection has a multifunctional character, which further improves the compactness of the cutting unit.

Preferably, in said interconnected condition, the first snap connection structure and the second snap connection structure allow an amount of play of at least 0.2 millimeter, and preferably at least 0.4 millimeter, in respect of translational movement of the internal cutting member relative to the external cutting member in a direction parallel to said rotation axis. Said allowed translational movement improves the performance of the cutting unit, since during the cutting of a hair, the cutting forces present tend to press the cooperating cutting edges of the internal and external cutting member somewhat apart from one another. It is important to allow these cutting edges to thus move apart, since it will cause the contact pressure between the internal and external cutting member to be decreased during cutting of a hair, which decreases friction. As a further clarification, it is noted that usually in rotary shavers the drive member of the internal cutting member resiliently presses the internal cutting member in the direction of the external cutting member, which is usually realized by using a helical spring or the like. In such a case, a short time after the hair has been cut, spring force will cause the internal cutting member to move back in the direction of the external cutting member again. Some degree of decaying vibratory effect (known as the "bouncing effect") may then occur, wherein the internal cutting member under said spring force bounces a few times against the external cutting member.

In a further preferable embodiment of the invention, the cutting unit further comprises a magnet system configured, arranged and effective to provide magnetic attraction at least between the first central portion and the second central portion for providing at least part of said holding force. The use of such a magnet system provides the user with a very easy, comfortable and intuitive way to precisely position the internal cutting member relative to the external cutting member. It is noted that such a magnet system may comprise a permanent magnet or an electromagnet. The first central portion may contain a magnet. Similarly, the second central portion may contain a magnet.

In a further preferable embodiment, said magnet system comprises a magnet associated with and arranged in and/or at the first central portion for providing said magnetic attraction. In such an embodiment, the second central portion may contain magnetizable material.

Preferably, in said interconnected condition a magnetic axis of said magnet associated with the first central portion is aligned with said rotation axis. By virtue of this alignment of said magnetic axis and the rotation axis, said magnetic attraction is very effective, while at the same time said rotative movement is very smooth.

In a further preferable embodiment, said magnet system comprises a magnet associated with and arranged in and/or at the second central portion for providing said magnetic attraction. In such an embodiment the first central portion may contain magnetizable material.

Preferably, in said interconnected condition a magnetic axis of said magnet associated with the second central portion is aligned with said rotation axis. By virtue of this alignment of said magnetic axis and the rotation axis, said magnetic attraction is very effective, while at the same time said rotative movement is very smooth.

The invention may also be embodied in a shaving head for use in a shaving device for shaving hairs, said shaving head comprising at least one cutting unit according to the invention.

In a preferable embodiment of a shaving head according to the invention, the shaving head comprises at least one cutting unit, wherein each cutting unit comprises:

- an external cutting member comprising a shaving surface, which is interrupted by an apertured structure for allowing hairs to pass; and
- an internal cutting member, which is drivable for rotative movement relative to the external cutting member about a rotation axis and along said apertured structure in the shaving surface of the external cutting member for cutting through hairs passing said apertured structure;

and wherein:

- the external cutting member and the internal cutting member have:
- an interconnected condition, in which the external cutting member and the internal cutting member are mutually interconnected for operation of the shaving head, and
- a disconnected condition, in which the external cutting member and the internal cutting member are mutually disconnected for taking at least the internal cutting member out of the shaving head for cleaning the cutting unit;
- the external cutting member has a first central portion and the internal cutting member has a second central portion, wherein in said interconnected condition said rotation axis is a centre line of the first central portion as well as of the second central portion;
- in said interconnected condition a holding force prevents the external cutting member and the internal cutting member from moving apart into the disconnected condition;
- said holding force is at least exerted by the first central portion upon the second central portion, and/or vice versa; and
- said disconnected condition is obtainable from said interconnected condition by manually moving the external cutting member and the internal cutting member away from one another in a direction parallel to said rotation axis by means of a manual force action overcoming said holding force, wherein the shaving head further comprises a magnet system configured, arranged and effective to provide magnetic attraction at least between the first central portion and the second central portion for providing at least part of said holding force, and wherein said magnet system comprises a magnet associated with the shaving head and arranged in and/or at the shaving head so as to be remote from the first central portion and from the second central portion for magnetically influencing the first central portion and the second central portion for providing said magnetic attraction. In this embodiment of the invention, the magnet is arranged in a support structure of the shaving head that carries, supports or contains the one or more cutting units, i.e. at a location in the shaving head separate and remote from the one or more cutting units. In this embodiment, the magnet magnetically influences the first central portion of the external cutting member and the second central portion of the internal cutting member, and the first and second central portions contain a magnetizable material.

In a further embodiment, said at least one cutting unit is a multiplicity of respective cutting units, and the shaving head comprises a magnet system configured, arranged and effective to provide magnetic attraction at least between the first central portion and the second central portion of each respective cutting unit for providing at least part of said holding force, and said magnet system comprises a magnet associated with the shaving head and arranged in and/or at the shaving head so as to be remote from the first central portion and the second central portion of each respective cutting unit for simultaneously magnetically influencing said first and second central portions of each respective cutting unit for providing said magnetic attraction between the first and second central portions of each respective cutting unit. The use of such a magnet associated with the shaving head allows the manufacture of the internal and external cutting members of the shaving head without providing any magnets therein. All that is needed is magnetizable material in and/or at the first and second central portions of the external and internal cutting members.

The invention may also be embodied in a shaving device for shaving hairs, comprising:

- a shaving device main body which is intended to be taken hold of by a user of the shaving device, and which serves for accommodating various members of the shaving device; and
- a shaving head according to the invention, the shaving head being connected or connectable to the shaving device main body for operation of the shaving device.

BRIEF DESCRIPTION OF THE DRAWINGS

The above mentioned aspects and other aspects of the invention will be apparent from and elucidated with reference to the embodiments described hereinafter by way of non-limiting examples only and with reference to the schematic figures in the enclosed drawing.

Figure 1:
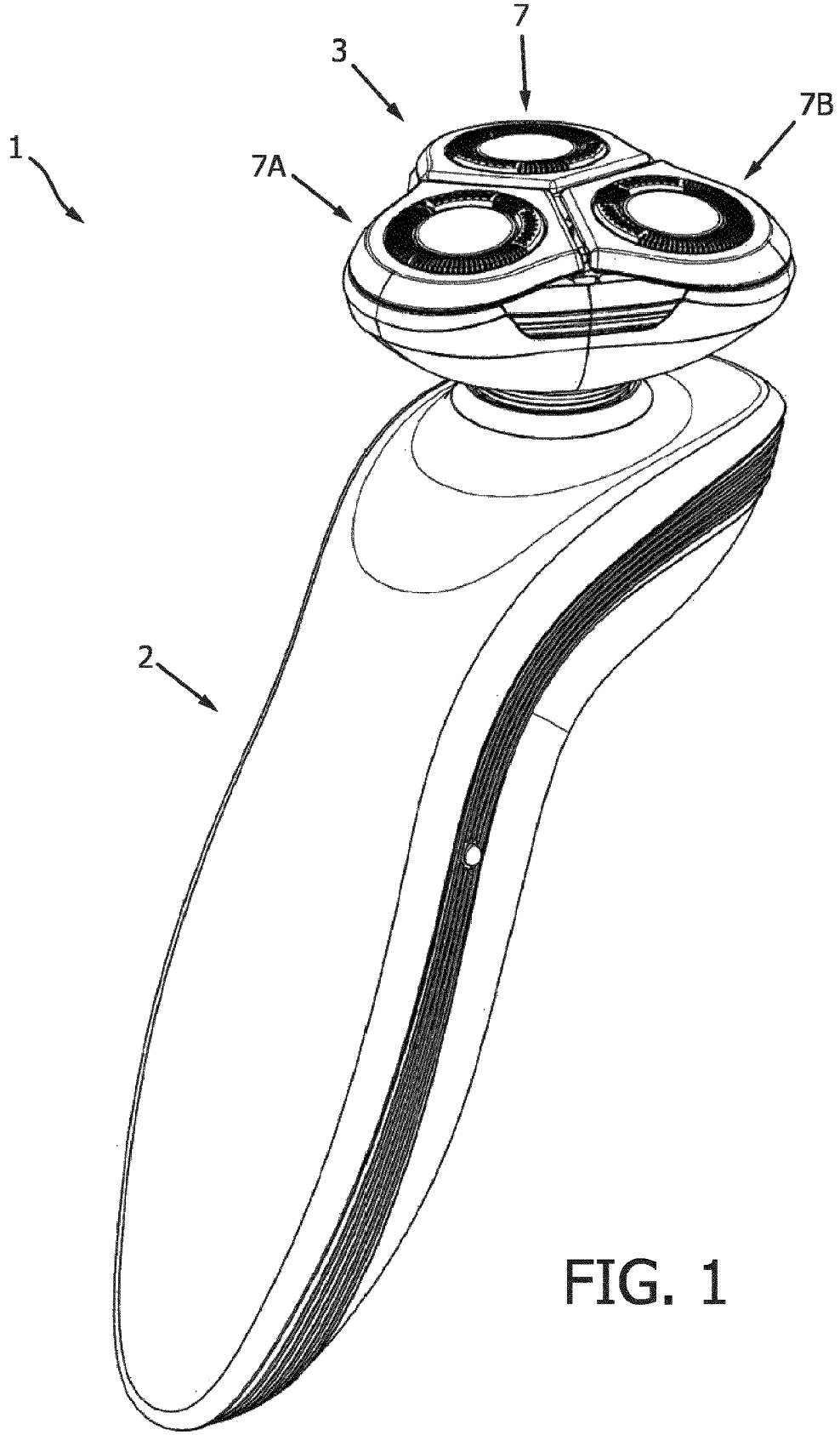
FIG. 1 shows, in a perspective view, an example of a shaving device according to the invention, which shaving device comprises an example of a first embodiment of a shaving head according to the invention.

The reference signs used in the abovementioned FIGS. 1-6 refer to the abovementioned parts and aspects of the invention, as well as to related parts and aspects, in the following manner.

1 shaving device
2 shaving device main body
3 shaving head
4 shaving head driving body
5; 305 shaving head cutting body
6, 6A, 6B drive shaft
7, 7A, 7B; 207; . . . 307, 307A cutting unit
8; 308 frame of shaving head cutting body
10; 210; 310, . . . . . 310A rotation axis
11; 211; 311, . . . 311A external cutting member
12; 212; 312, . . . 312A internal cutting member
14 skin supporting member
15 fixation ring for external cutting member 11
16 shaving surface of external cutting member 11
20 play
21; 221; 321, . . . 321A first central portion
22; 222; 322, . . . 322A second central portion
230; 330 magnet
240 magnetic field

DETAILED DESCRIPTION OF THE EMBODIMENTS

Reference is first made to FIGS. 1-4, which show the shaving device 1 based on the first embodiment of the shaving head.

FIG. 1 shows that the shaving device 1 comprises the shaving device main body 2 and the shaving head 3 being connected thereto.

Figure 2:
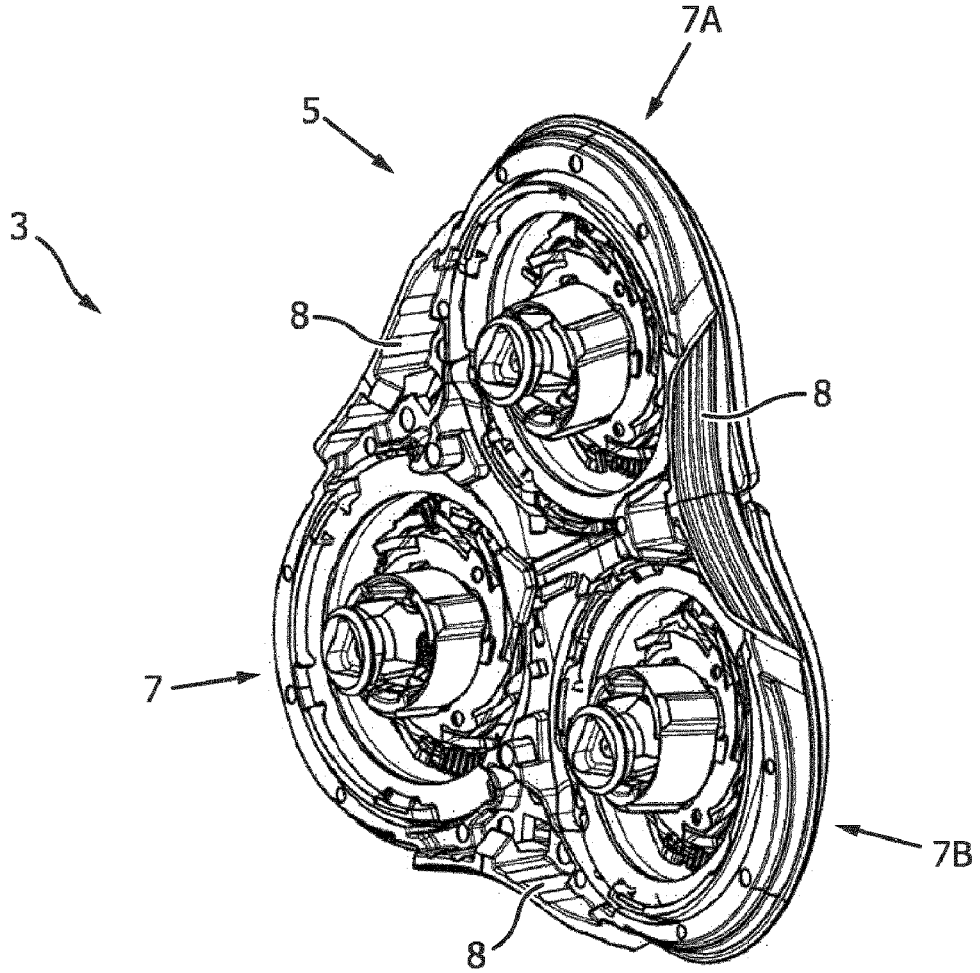
FIG. 2 separately shows, in a perspective view, said first embodiment of the shaving head again, however, this time in an opened condition of the shaving head.
Figure 2:
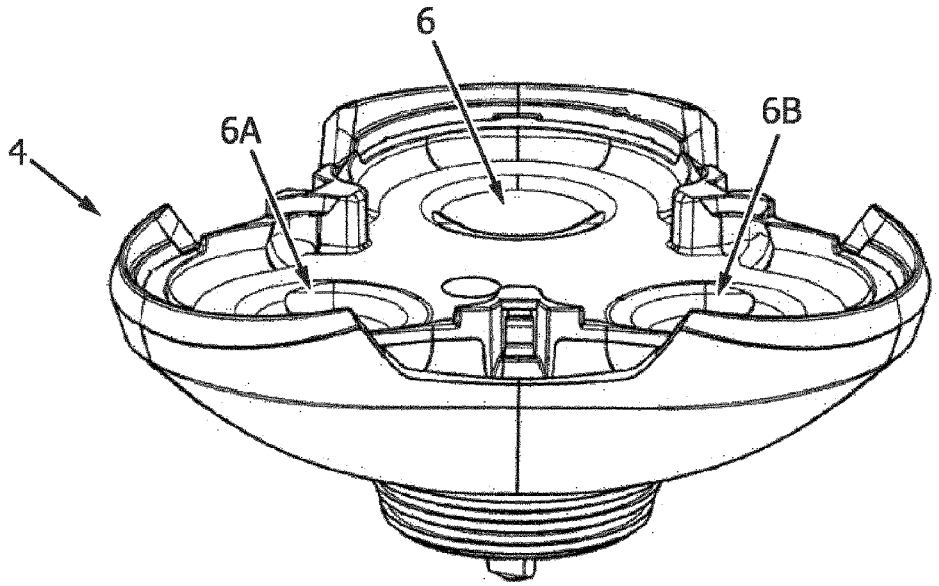

FIG. 2 shows that the shaving head 3 can be taken apart into the shaving head driving body 4 and the shaving head cutting body 5. The shaving head cutting body 5 has the frame 8, to which the three identical first cutting units 7, 7A, 7B of the shaving head 3 are connected. The shaving head driving body 4 has the three driving shafts 6, 6A, 6B for driving the three internal cutting members 12 of the three cutting units 7, 7A, 7B, respectively.

Figure 3:
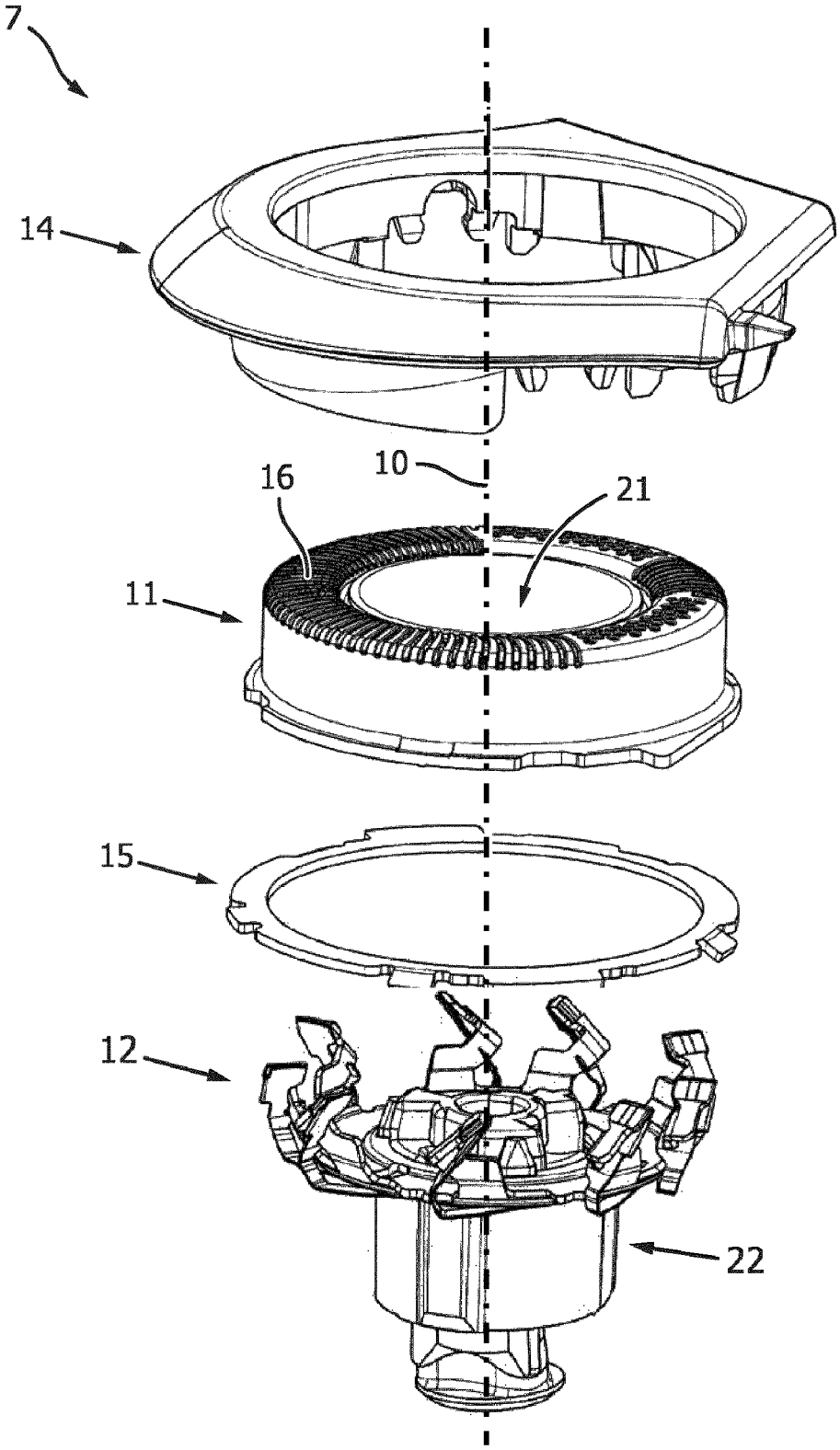
FIG. 3 separately shows, in a perspective view, one of three identical cutting units according to an embodiment of the invention of said first embodiment of the shaving head in a disassembled condition of the shown cutting unit, hereinafter also referred to as "(the) first cutting unit", wherein the external and internal cutting members of the first cutting unit are in the disconnected condition.

FIG. 3 shows that the first cutting unit 7 comprises the external cutting member 11 and the internal cutting member 12. In operation of the shaving head 3, the shown skin supporting member 14 of the shaving head cutting body 5 is suspended relative to the frame 8 of the shaving head cutting body 5, while at the same time the external cutting member 11 is connected relative to the skin supporting member 14 via the shown fixation ring 15. The external cutting member 11 has the shaving surface 16, which is interrupted by an apertured structure for allowing hairs to pass.

Figure 4:
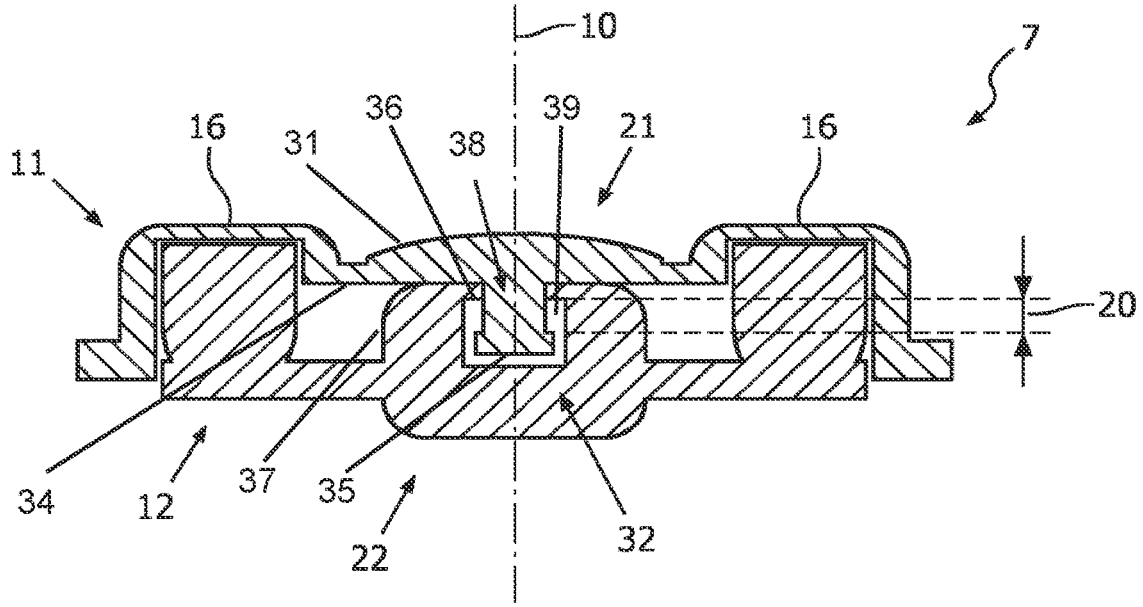
FIG. 4 shows said first cutting unit in a cross-section parallel to, and containing the rotation axis of, the first cutting unit, and wherein the external and internal cutting members of the first cutting unit are in the interconnected condition.

FIG. 4 shows the first cutting unit 7 in the interconnected condition of the external and internal cutting members 11, 12. In FIG. 4 it is seen that the first central portion 21 of the external cutting member 11 comprises the first snap connection structure 31, while the second central portion 22 of the internal cutting member 12 comprises the second snap connection structure 32. It is also seen that the first snap connection structure 31 and the second snap connection structure 32 provide radial bearing support, i.e. bearing support in a radial direction relative to the rotation axis 10, for the rotative movement of the internal cutting member 12 relative to the external cutting member 11 about the rotation axis 10. FIG. 4 furthermore illustrates that the first snap connection structure 31 and the second snap connection structure 32 allow the abovementioned amount of play 20 in respect of translational movement of the internal cutting member 12 relative to the external cutting member 11 in a direction parallel to the rotation axis 10.

In the shown example, the first snap connection structure 31 includes a first radial extension 34 and a bearing stud 38, extending from the first radial extension 34, wherein a free end 35 of the bearing stud 38 has a locally increased diameter, while the second snap connection structure 32 defines a cylindrical recess 39, whose entry opening has a locally decreased diameter provided by a second radial extension 36 extending radially from a circumferential wall 37 of the second snap connection structure 32, while allowing the play 20. In general, the bearing surfaces of the rotative movement between the external and internal cutting members may, amongst others, be formed with such a locally decreased diameter surface of the entry opening of the cylindrical recess and/or such a locally increased diameter surface of the free end of the bearing stud and/or with any other surfaces of the external and internal cutting members.

Generally, the first snap connection structure and/or the second snap connection structure may for example be made of a resilient material. In the shown example, the structure defining the cylindrical recess 32 may for example be made of a resilient plastic material.

The snap connection is preferably designed in such a manner that said holding forces in the first place are sufficient for the internal cutting members to remain in the external cutting members at least when the shaving head 3 is being taken apart from the situation as shown in FIG. 1 into the situation of FIG. 2. In the second place, to keep each internal cutting member in the external cutting member after the shaving head cutting body 5 has been separated from the shaving head driving body 4, said holding forces should preferably be sufficient to carry several times the mass of an internal cutting member (which usually is not much more than 1 g). All in all, the snap connection is preferably designed in such a manner that in the situation of FIG. 2 the manual pulling force required to remove an internal cutting member from an external cutting member will be in the order of magnitude of less than about 20 gf. When inserting an internal cutting member back into an external cutting member after a cleaning step, a gentle push will cause the internal cutting member to snap into place again.

Figure 5:
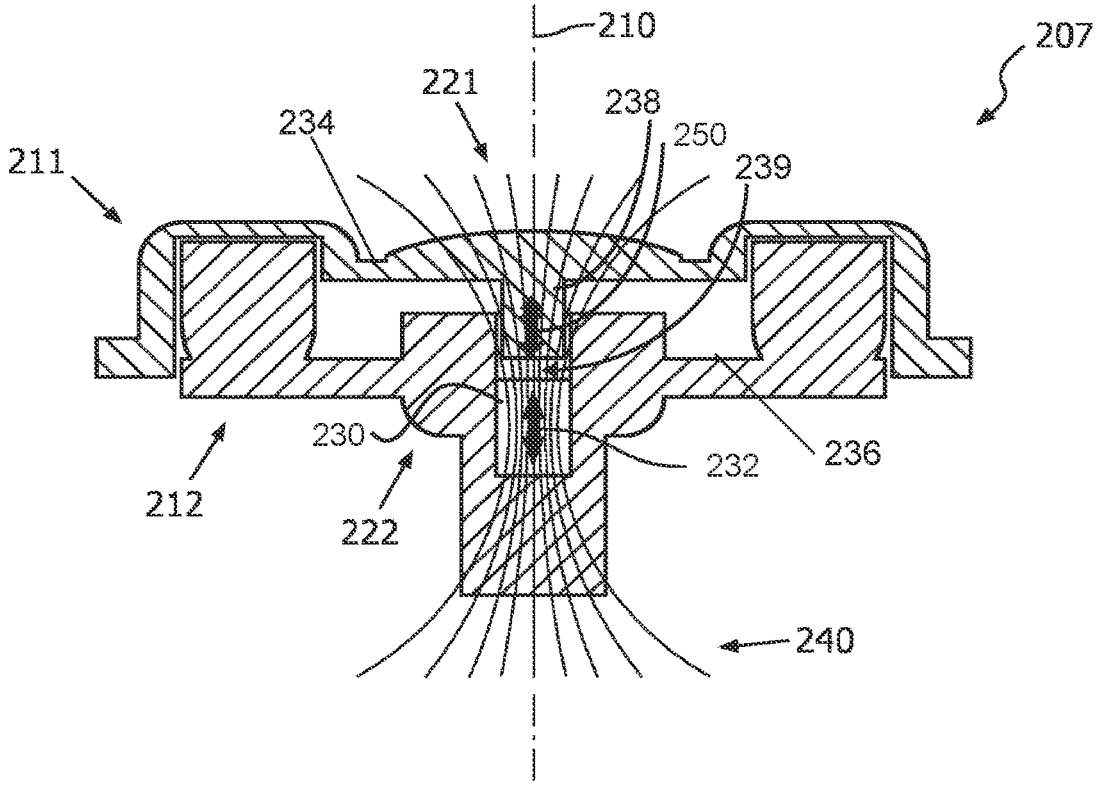
FIG. 5 shows an example of a further embodiment of a cutting unit according to the invention, hereinafter also referred to as "(the) second cutting unit", for use in an example of a second embodiment of a shaving head according to the invention, wherein said second cutting unit is shown in a cross-section parallel to, and containing the rotation axis of, the second cutting unit, and wherein the external and internal cutting members of the second cutting unit are in the interconnected condition.

Reference is now made to FIG. 5, which shows the second cutting unit 207 for use in the abovementioned second embodiment of a shaving head according to the invention. The second cutting unit 207 comprises the external cutting member 211 and the internal cutting member 212. It is seen that the first central portion 221 and the second central portion 222 are mutually co-operating portions providing radial bearing support for the rotative movement about the rotation axis 210. As shown, there is a first radial extension 234 and a second radial extension 236. The first central portion 221 includes a bearing stud 238 extending outward. The second central portion 222 defines a cylindrical recess 239. In the interconnected condition shown in FIG. 5, the bearing stud 238 is received within the cylindrical recess 239.

Furthermore it is seen that, in the shown example, the magnet 230 is associated with, and arranged in, the second central portion 222 for providing the abovementioned magnetic attraction between the first central portion 221 and the second central portion 222. In the shown example, the first central portion 221 comprises magnetizable material. Similarly, a magnet may be associated with, and arranged in, the first central portion 221 for providing the abovementioned magnetic attraction between the first central portion 221 and the second central portion 222. The magnet arranged in the first central portion 221 may be utilized in place of or together with the magnet 230. Accordingly, while the first central portion 221 may contain a magnet, no physical size or position of the magnet relative to the first central portion 221 is depicted or related by FIG. 5. Similarly, the second central portion 222 may contain a magnet 230. When the magnet arranged in the first central portion 221 is utilized in place of the magnet 230, the second central portion 222 comprises magnetizable material. One or more of the magnets may have a rectangular profile when viewed perpendicular to the rotation axis 210. Preferably, in an interconnected condition, a magnetic axis 250 of the magnet arranged in the first central portion 221 and/or a magnetic axis 232 of the magnet associated with the second central portion 222 is aligned with a rotation axis of the internal cutting member 212 relative to the external cutting member 211. By virtue of this alignment of the magnetic axis and the rotation axis, the magnetic attraction is very effective, while at the same time, the rotative movement is very smooth.

In FIG. 5, the magnetic axis 232 of the magnet 230 has been indicated by means of the depicted two-way arrow, while the corresponding magnetic field of the magnet 230 has been indicated by means of the magnetic field lines 240. Hence, the magnet 230 is placed so as to have its magnetic axis aligned with the rotation axis 210. In the shown example, the magnetic field thus is maximally coupled with the bearing stud 238 of the first central portion 221. Usually, such a bearing stud contains a relatively large proportion of the material of the external cutting member, as a result of which the placement of the magnet 230, as shown, is very favorable.

A practical shape for the magnet used is a cylindrical shape having a diameter of between 2 and 3 mm and a height of between 1 and 3 mm. The force-density requirements are modest, so a relatively low-cost grade of neodymium magnet is already sufficient.

Figure 6:
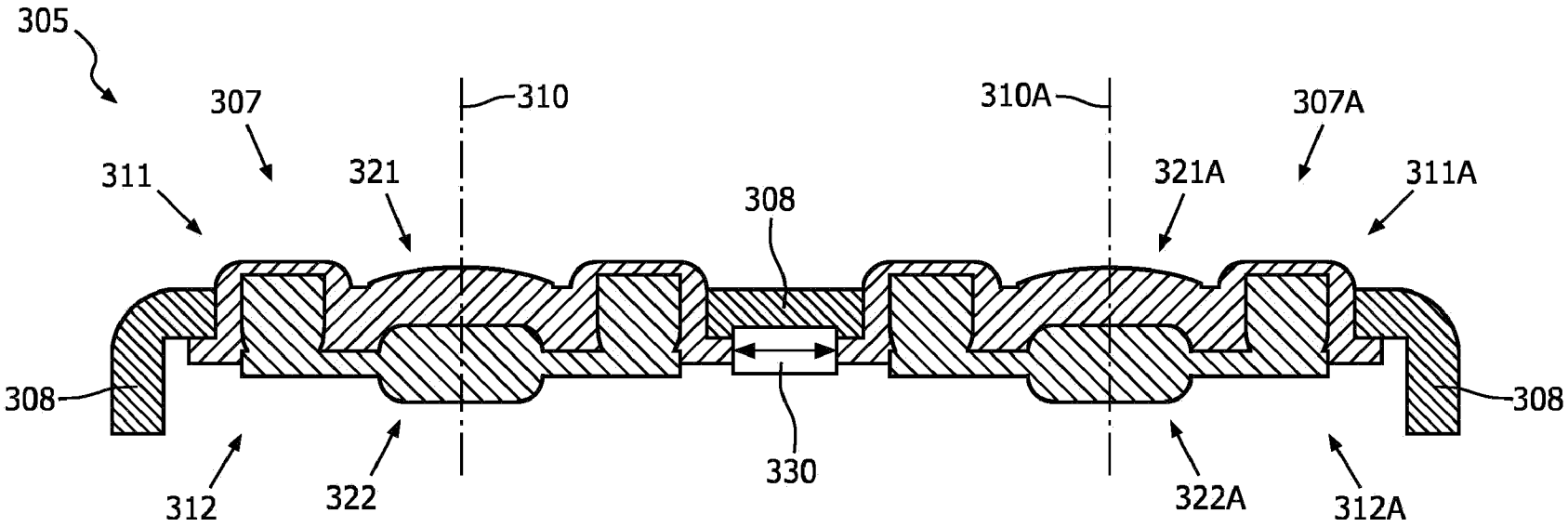
FIG. 6 shows an example of an embodiment of a part of a third embodiment of a shaving head according to the invention, which shaving head comprises two identical cutting units, hereinafter also referred to as "(the) third cutting units", wherein said part of the shaving head is shown in a cross-section parallel to, and containing the two respective rotation axes of, the two respective third cutting units, and wherein the external and internal cutting members of the two third cutting units are in the interconnected condition.

Reference is now made to FIG. 6, which shows a cutting body 305 of the abovementioned third embodiment of a shaving head according to the invention. This shaving head cutting body 305 comprises the two third cutting units 307 and 307A, which are connected to the frame 308 of the shaving head cutting body 305. The third cutting unit 307 comprises the external cutting member 311 and the internal cutting member 312. It is seen that the first central portion 321 and the second central portion 322 are mutually co-operating portions providing radial bearing support for the rotative movement about the rotation axis 310. Similarly, the third cutting unit 307A comprises the external cutting member 311A and the internal cutting member 312A, while the first central portion 321A and the second central portion 322A are mutually co-operating portions providing radial bearing support for the rotative movement about the rotation axis 310A.

Furthermore, it is seen that, in the shown example, the magnet 330 is associated with the shaving head and arranged in the shaving head so as to be remote from the first central portions 321 and 321A and from the second central portions 322 and 322A for magnetically influencing these first central portions and these second central portions for providing the abovementioned magnetic attraction between the first central portion 321 and the second central portion 322, as well as for simultaneously providing the abovementioned magnetic attraction between the first central portion 321A and the second central portion 322A.

In FIG. 6, the magnetic axis of the magnet 330 has been indicated by means of the depicted two-way arrow. In the shown example, each one of the first central portions 321, 321A and the second central portions 322, 322A comprises magnetizable material.

While the invention has been described and illustrated in detail in the foregoing description and in the figures, such description and illustration are to be considered exemplary and/or illustrative and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. For the purpose of clarity and a concise description, features are disclosed herein as part of the same or separate embodiments, however, it will be appreciated that the scope of the invention may include embodiments having combinations of all or some of the features disclosed. The mere fact that certain measures are recited in mutually different dependent claims does not indicate that a combination of these measures can not be used to advantage.

Any reference signs in the claims should not be construed as limiting the scope.

The invention claimed is:

1. A cutting unit for use in a shaver for shaving hairs, the cutting unit comprising:

an external cutting member comprising a shaving surface, wherein the shaving surface is interrupted by an apertured structure for allowing hairs to pass; and an internal cutting member, wherein the internal cutting member is drivable for rotative movement relative to the external cutting member about a rotation axis and along the apertured structure in the shaving surface of the external cutting member for cutting through hairs passing the apertured structure;

wherein;

the external cutting member and the internal cutting member have:

an interconnected condition, in which the external cutting member and the internal cutting member are mutually interconnected for operation of the cutting unit, and a disconnected condition, in which the external cutting member and the internal cutting member are mutually disconnected;

the external cutting member comprising a first central portion and the internal cutting member comprising a second central portion, wherein in the interconnected condition the rotation axis is a center line of the first central portion as well as of the second central portion, wherein the external cutting member is formed into a single part that includes the first central portion and wherein the internal cutting member is formed into a single part that includes the second central portion;

in the interconnected condition a holding force, that is at least exerted by the first central portion upon the second central portion, and/or by the second central portion upon the first central portion, prevents the external cutting member and the internal cutting member from moving apart, from the interconnected condition into the disconnected condition; and the disconnected condition is obtainable from the interconnected condition by manually moving the external cutting member and the internal cutting member away from one another in a direction parallel to the rotation axis by means of a manual force action overcoming the holding force, wherein the external cutting member and the internal cutting member remain as the single parts respectively when in the disconnected condition, and wherein the first central portion comprises a stud extending outward and the second central portion defines a cylindrical recess such that in the interconnected condition, the stud is received within the cylindrical recess, the cutting unit further comprising a magnet system configured to provide magnetic attraction at least between the stud and the second central portion for providing at least part of the holding force, wherein the magnet system comprises a magnet arranged in and/or at the second central portion during the interconnected condition and during the disconnected condition, the magnet providing the magnetic attraction.

2. The cutting unit according to claim 1, wherein in the interconnected condition a magnetic axis of the magnet arranged in and/or at the second central portion is aligned with the rotation axis and the magnet is positioned to intersect with the rotation axis.

3. The cutting unit according to claim 1, wherein the magnet has a rectangular profile when viewed perpendicular to the rotation axis.

4. The cutting unit according to claim 1, wherein the magnet is arranged within the recess during the interconnected condition and during the disconnected condition.

5. The cutting unit according to claim 4, wherein the magnet has a rectangular profile when viewed perpendicular to the rotation axis.

6. The cutting unit according to claim 1, wherein the magnet is arranged within the recess during the interconnected condition and during the disconnected condition, and wherein in the interconnected condition a magnetic axis of the magnet arranged within the recess is aligned with the rotation axis and is positioned to intersect with the rotation axis.

7. The cutting unit according to claim 1, wherein in the interconnected condition the stud and the cylindrical recess each have a corresponding side wall providing radial bearing support for the rotative movement.

8. The cutting unit according to claim 1, wherein the cutting unit s a rotary cutting unit coupled to a rotative drive shaft.

9. A shaving head for use in a shaver for shaving hairs, the shaving head comprising at least one cutting unit according to claim 8 and a shaving head driving body configured to support the at least one cutting unit.

10. A shaving device for shaving hairs, comprising:

a shaving device main body configured to be taken hold of by a user of the shaving device; and the shaving head according to claim 9, the shaving head being connected or connectable to the shaving device main body for operation of the shaving device.

11. The shaving head according to claim 9, wherein the at least one cutting unit is at least two cutting units.

12. A shaving head for use in a shaver for shaving hairs, the shaving head comprising at least one cutting unit according to claim 1 and a shaving head driving body configured to support the at least one cutting unit.

13. A shaving device for shaving hairs, comprising:

a shaving device main body configured to be taken hold of by a user of the shaving device; and the shaving head according to claim 12, the shaving head being connected or connectable to the shaving device main body for operation of the shaving device.

14. The shaving head according to claim 12, wherein the at least one cutting unit is at least two cutting units.

15. A cutting unit for use in a shaver for shaving hairs, the cutting unit comprising:

an external cutting member comprising a shaving surface, wherein the shaving surface is interrupted by an apertured structure for allowing hairs to pass; and an internal cutting member, wherein the internal cutting member is drivable for rotative movement relative to the external cutting member about a rotation axis and along the apertured structure in the shaving surface of the external cutting member for cutting through hairs passing the apertured structure;

the external cutting member comprising a first central portion and the internal cutting member comprising a second central portion, wherein the external cutting member and the internal cutting member have:

a disconnected condition in which the external cutting member and the internal cutting member are mutually disconnected; and an interconnected condition, in which the external cutting member and the internal cutting member are mutually interconnected by a holding force that is at least exerted axially by the first central portion upon the second central portion, and/or that is at least exerted axially by the second central portion upon the first central portion, wherein the holding force is provided directly between the first and second central portions and prevents the external cutting member and the internal cutting member from moving apart in a direction parallel to the rotation axis, from the interconnected condition into the disconnected condition; and the disconnected condition is obtained from the interconnected condition by an act consisting essentially of applying a manual force directly to the internal cutting member overcoming the holding force to move the external cutting member and the internal cutting member away from one another in the direction parallel to the rotation axis, the cutting unit further comprising a magnet system configured to provide magnetic attraction at least between the first central portion and the second central portion for providing at least part of the holding force, wherein the magnet system comprises a magnet arranged in and/or at the internal cutting member during the interconnected condition and during the disconnected condition, the magnet providing the magnetic attraction.

16. The cutting unit according to claim 15, wherein the magnet is arranged in and/or at the second central portion during the interconnected condition and during the disconnected condition, the magnet providing the magnetic attraction, and wherein the magnet is positioned to intersect with the rotation axis.

17. The cutting unit according to claim 15, wherein the first central portion comprises a stud extending from a first radial extension of the first central portion and the second central portion defines a cylindrical recess such that in the interconnected condition, the stud is received within the cylindrical recess, and wherein the magnetic attraction is between the stud and the second central portion.

18. The cutting unit according to claim 17, wherein the magnet is arranged within the recess during the interconnected condition and during the disconnected condition.

* * * * *